US010134374B2

(12) United States Patent
Kayama

(10) Patent No.: US 10,134,374 B2
(45) Date of Patent: Nov. 20, 2018

(54) SIGNAL PROCESSING METHOD AND SIGNAL PROCESSING APPARATUS

(71) Applicant: YAMAHA CORPORATION, Hamamatsu-shi (JP)

(72) Inventor: Hiraku Kayama, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/800,462

(22) Filed: Nov. 1, 2017

(65) Prior Publication Data

US 2018/0122346 A1 May 3, 2018

(30) Foreign Application Priority Data

Nov. 2, 2016 (JP) ..... 2016-214889
Nov. 2, 2016 (JP) ..... 2016-214891

(51) Int. Cl.

| | |
|---|---|
| ***G10H 1/36*** | (2006.01) |
| ***G10H 1/02*** | (2006.01) |
| ***G10H 1/44*** | (2006.01) |
| ***G10H 1/46*** | (2006.01) |

(52) U.S. Cl.
CPC ..... *G10H 1/02* (2013.01); *G10H 1/44* (2013.01); *G10H 1/46* (2013.01); *G10H 2210/066* (2013.01)

(58) Field of Classification Search
CPC ..... G10H 1/366; G10H 2210/066; G10H 2210/081; G10H 2210/165; G10H 2210/561; G10H 2250/455; G10H 2250/481; G10H 1/02; G10H 1/44; G10H 1/46
USPC ..... 84/610
See application file for complete search history.

(56) References Cited

U.S. PATENT DOCUMENTS

| | | | | |
|---|---|---|---|---|
| 5,525,062 A * | 6/1996 | Ogawa | G09B 15/00 386/230 |
| 5,621,182 A * | 4/1997 | Matsumoto | G10H 1/366 434/307 A |
| 5,750,912 A * | 5/1998 | Matsumoto | G10H 1/366 434/307 A |
| 5,857,171 A * | 1/1999 | Kageyama | G10H 1/366 704/268 |
| 5,889,223 A * | 3/1999 | Matsumoto | G10H 1/366 434/307 A |

(Continued)

FOREIGN PATENT DOCUMENTS

| | | |
|---|---|---|
| JP | 2000003200 A | 1/2000 |
| JP | 2007240564 A | 9/2007 |
| JP | 2013137520 A | 7/2013 |

*Primary Examiner* — Jeffrey Donels
(74) *Attorney, Agent, or Firm* — Rossi, Kimms & McDowell LLP

(57) ABSTRACT

A signal processing method includes a first specifying step and a first modifying step. In the first specifying step, a first modification object section for a singing voice of a music is specified based on a temporal change of pitch of singing voice data representing the singing voice or a temporal change of pitch in a score of the music. In the first modifying step, a modifying process is performed to the singing voice data. The modifying process modifies at least one of the temporal change of pitch and the temporal change of volume of the singing voice in the first modification object section which is specified by the first specifying step.

10 Claims, 5 Drawing Sheets

(56) References Cited

U.S. PATENT DOCUMENTS

| | | | | | |
|---|---|---|---|---|---|
| 5,889,224 | A * | 3/1999 | Tanaka | G10H 1/361 | 434/307 A |
| 5,955,693 | A * | 9/1999 | Kageyama | G10H 1/366 | 84/610 |
| 5,963,907 | A * | 10/1999 | Matsumoto | G10H 1/365 | 434/307 A |
| 7,825,321 | B2 * | 11/2010 | Bloom | G10H 1/366 | 84/622 |
| 7,974,838 | B1 * | 7/2011 | Lukin | G10H 1/366 | 704/207 |
| 8,423,367 | B2 * | 4/2013 | Saino | G10H 1/0008 | 704/267 |
| 9,818,396 | B2 * | 11/2017 | Tachibana | G10L 13/0335 | |
| 2013/0019738 | A1 * | 1/2013 | Haupt | G10H 1/06 | 84/622 |
| 2015/0040743 | A1 * | 2/2015 | Tachibana | G10H 1/361 | 84/622 |

* cited by examiner

SIGNAL PROCESSING METHOD AND SIGNAL PROCESSING APPARATUS

CROSS REFERENCE TO RELATED APPLICATIONS

This application is based on Japanese Patent Application (No. 2016-214889) filed on Nov. 2, 2016 and Japanese Patent Application (No. 2016-214891) filed on Nov. 2, 2016, the contents of which are incorporated herein by way of reference.

BACKGROUND

The present invention relates to a signal processing technique concerning a singing voice.

In recent years, it is a common practice that a person who is not a professional singer captures his/her own singing scene as a moving image and posts the moving image on a moving image posting site or the like.

[Patent Document 1] JP 2007-240564 A

[Patent Document 2] JP 2013-137520 A

[Patent Document 3] JP 2000-003200 A

It is often the case that posters on the moving image post their moving images with the same feeling as when singing karaoke songs. There are some posters, among the posters on the moving image, who desire to modify their singing voice to a singing voice which gives listeners the impression of singing well and post the modified moving images. However, there has heretofore been no technique serving such a need.

Examples of a signal processing technique concerning a singing voice include techniques disclosed in Patent Document 1 and Patent Document 2. The technique disclosed in Patent Document 1 is a technique which imparts a motion to a pitch according to a predetermined pitch model so as for the pitch to change continuously in note switching portions. On the other hand, the technique disclosed in Patent Document 2 is a technique which, by providing each note with control information defines a change in pitch, controls the change in pitch from a sound production start time point until reaching a target pitch according to the control information. However, the techniques disclosed in the individual documents of Patent Document 1 and Patent Document 2 are both a technique for uniquely synthesizing natural singing voices according to a singing synthetic score or the like, and neither of them is a technique which controls for each singer the skill impression of the singing voices of persons different in personality. There is a problem that supposing that a singing voice is attempted to be modified by the technique disclosed in Patent Document 1 or Patent Document 2, the singing voice is modified so as to have a pitch motion (pitch change) shown in the predetermined pitch model (control information), as a result of which all the singing voices, no matter how they are, become of the same pitch motion (pitch change), and the personalities of the singers are completely eliminated.

An example of a technique which changes an impression of a singing voice is disclosed in Patent Document 3. Patent Document 3 discloses a technique in which a male voice is modified to a pitch conversion and then added with aspirated noise according to format of the converted voice, thus being converted into a female voice natural in hearing sense. However, the technique disclosed in Patent Document 3 cannot change an impression of skill of singing.

SUMMARY

Therefore, the invention, having been contrived bearing in mind the heretofore described circumstances, provides a technique that can change an impression of skill of a singing voice while remaining the personality of a singer.

According to advantageous aspects of the invention, a signal processing method includes specifying a first section of a singing voice of a music based on a temporal change of a pitch of singing voice data representing the singing voice or a temporal change of a pitch in a score of the music. Further, singing voice data representing the first section of the singing voice is modified such that a temporal change of at least one of the pitch, a volume, and a spectral envelope of the singing voice data representing the first section of the singing voice is modified.

DETAILED DESCRIPTION OF EXEMPLIFIED EMBODIMENTS

Embodiments according to the invention will be explained with reference to accompanying drawings.

First Embodiment

Figure 1:
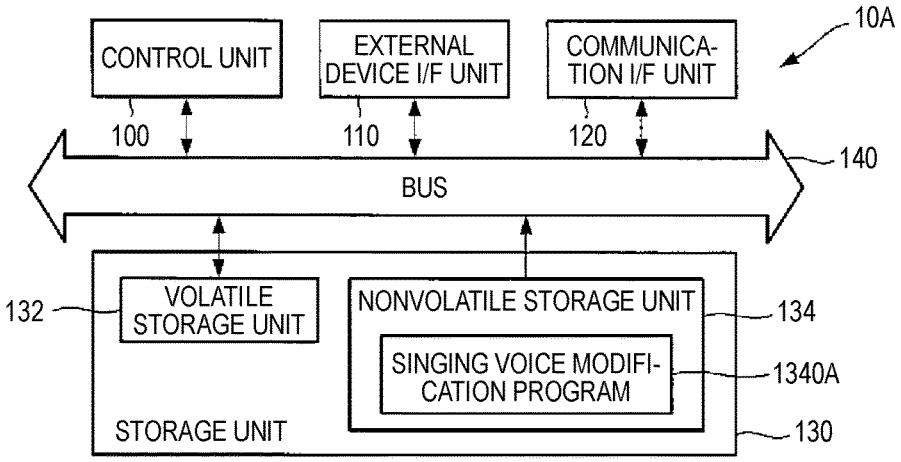
FIG. 1 is a diagram illustrating a configuration example of a signal processing apparatus 10A according to a first embodiment of the invention.

FIG. 1 is a diagram illustrating a configuration example of a signal processing apparatus 10A according to a first embodiment of the invention. The signal processing apparatus 10A is, for example, a personal computer and includes a control unit 100, an external device interface (hereinafter abbreviated as "I/F") unit 110, a communication I/F unit 120, a storage unit 130, and a bus 140 via which data is transmitted between these constituent elements, as illustrated in FIG. 1.

The signal processing apparatus 10A is used by a poster who posts a moving image to a moving image posting site.

A poster or the like of the moving image captures and records an image of his/her own singing state. Posting on a moving image posting site means that moving image data is uploaded to a server of the moving image posting site. The moving image data of the posted moving image contains singing voice data representing a singing voice of an entire singing music as a singing target (for example, a singing voice corresponding to a piece of music). A specific example of such singing voice data may include a sample sequence which is obtained by sampling sound waves of a singing voice with a predetermined sampling period.

The signal processing apparatus 10A executes singing voice modification processing. The singing voice modification processing is signal processing which uses singing voice data as a processing target and remarkably represents the feature of the embodiment. Specifically, the singing voice modification processing is processing in which singing voice data is modified so as to give an impression of good singing to listeners while remaining the personality of a singer of the singing voice represented by the singing voice data. By performing the singing voice modification processing on singing voice data contained in moving image data before uploading the moving image data, a poster on the moving image can modify the singing voice data to a singing voice which gives the impression of good singing to listeners and can post the modified singing voice. Hereinafter, functions of the individual constituent elements constituting the signal processing apparatus 10A will be explained.

The control unit 100 is configured of, for example, a CPU. The control unit 100 operates according to programs stored in advance in the storage unit 130 (precisely, a nonvolatile storage unit 134) and thus functions as a control center of the signal processing apparatus 10A. Details of processing executed by the control unit 100 according to various kinds of programs which are stored in advance in the nonvolatile storage unit 134 will be clarified later.

The external device I/F unit 110 is an aggregation of interfaces such as a USB (Universal Serial Bus) interface, a serial interface, and a parallel interface which connect the signal processing apparatus to other electronic devices. The external device I/F unit 110 receives data from the other electronic devices connected to this I/F unit and transfers the data to the control unit 100, and also outputs dada supplied from the control unit 100 to the other electronic devices. In this embodiment, a recording medium (for example, a USB memory), which stores singing voice data representing a singing voice in a moving image, is connected to the external device I/F unit 110. The control unit 100 reads the singing voice data stored in the recording medium as a processing target and executes the singing voice modification processing.

The communication I/F unit 120 is configured of, for example, an NIC (Network Interface Card). The communication I/F unit 120 is connected to an electric communication line such as the internet via a communication line such as a LAN (Local Area Network) cable and a relay device such as a router. The communication I/F unit 120 receives date transmitted via the electric communication line connected to this I/F unit and transfers the data to the control unit 100, and also outputs dada supplied from the control unit 100 to the electric communication line. For example, in response to an instruction from a user, the control unit 100 transmits moving image data containing singing voice data, which has been modified to the singing voice modification processing, to the server of the moving image posting site via the communication I/F unit 120. In this manner, posting of the moving image is achieved.

The storage unit 130 includes a volatile storage unit 132 and the nonvolatile storage unit 134 as illustrated in FIG. 1. The volatile storage unit 132 is configured of, for example, a RAM (Random Access Memory). The control unit 100 uses the volatile storage unit 132 as a work area at the time of executing the program. The nonvolatile storage unit 134 is configured of, for example, a flash ROM (Read Only Memory) or a hard disc drive. The nonvolatile storage unit 134 stores in advance a singing voice modification program 1340A which causes the control unit 100 to execute the singing voice modification processing. Although detailed illustration is omitted in FIG. 1, the nonvolatile storage unit 134 stores in advance a kernel program and a communication control program. The kernel program is a program which causes the control unit 100 to achieve an OS (Operation System). The communication control program is a program which causes the control unit 100 to execute processing of uploading moving image data to the server of the moving image posting site in accordance with a predetermined communication protocol such as an FTP (File Transfer Protocol).

When a power supply (not illustrated in FIG. 1) for the signal processing apparatus 10A is turned on, the control unit 100 firstly reads the kernel program from the nonvolatile storage unit 134 and stores in the volatile storage unit 132 to start execution of the kernel program. In a state that the control unit 100 is operated according to the kernel program and achieves the OS, when the control unit 100 is instructed to execute a program in response to an operation for an operation input unit (for example, a mouse or a keyboard not illustrated in FIG. 1) connected to the external device UF unit 110, the control unit 100 reads the program from the nonvolatile storage unit 134 and stores in the volatile storage unit 132 to start execution of this program.

Figure 2:
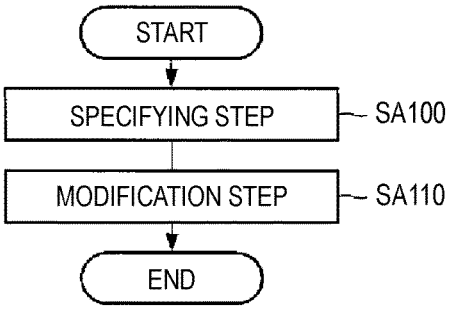
FIG. 2 is a flowchart illustrating a flow of singing voice modification processing which is executed by a control unit 100 of the signal processing apparatus 10A according to a singing voice modification program 1340A.

When the control unit 100 is instructed to execute the singing voice modification program 1340A in response to an operation for the operation input unit, the control unit 100 reads the singing voice modification program 1340A from the nonvolatile storage unit 134 and stores in the volatile storage unit 132 to start execution of this program. The control unit 100 operates according to the singing voice modification program 1340A to execute the singing voice modification processing. FIG. 2 is a flowchart illustrating a flow of the singing voice modification processing. The singing voice modification processing includes two steps, that is, a specifying step SA100 and a modification step SA110 as illustrated in FIG. 2.

The specifying step SA100 is a step of specifying a first section in which the singing voice is to be modified to make the singing voice give a good impression to listeners, based on a temporal change of pitch in a singing voice which is represented by singing voice data. In this embodiment, out of "singing start sections in each of which the singer starts singing of a phrase" and "pitch jump sections in each of which a pitch of the sounds jumps between two consecutive notes" in the singing voice, the control unit 100 specifies a section in which a pitch changes gradually as the first section. When the singing voice changes from a first note to a second note, the pitch of the singing voice "jumps" between these two consecutive notes if a pitch of the second note is more than a predetermined threshold (for example, several semitones) higher than a pitch of the first note.

Figure 3:
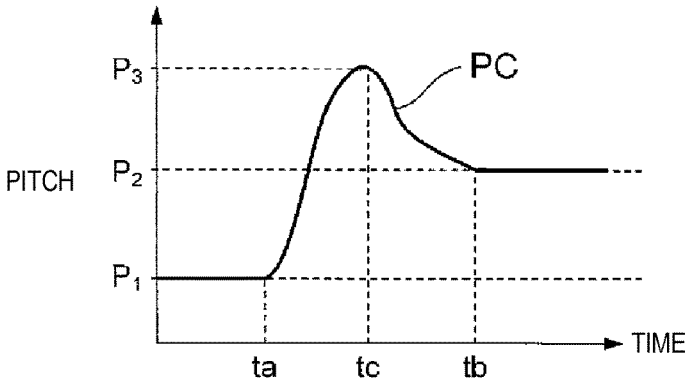
FIG. 3 is a diagram illustrating overshoot of a pitch.

The "singing start section" is a section where the singing voice transitions to a sounding state from a silent state of a predetermined time or more. Specifically, the "singing start section" is a start portion of each phrase such as a beginning portion of a singing music or a beginning portion of the second verse of a singing music when the first and second verses are sung by the singer while interposing an interlude portion therebetween. The gradual pitch change (a slow pitch change) means a state in which a change rate (speed) of a pitch between two consecutive notes of the singing voice is slower than predetermined criteria. An example of the slow pitch change may include a state in which overshoot of the pitch of the singing voice doesn't occur. As illustrated in FIG. 3, the overshoot of a pitch means a state in which the pitch changes from a pitch of a first note to a pitch of a second note with time in such a way that, before the pitch settles to the pitch of the second note, the pitch temporally goes beyond the pitch of the second note to a maximum pitch. FIG. 3 illustrates a pitch curve PC which represents temporal change of a pitch with the overshoot in a case where the pitch changes from a first pitch P1 at time to to a second pitch P2 at time tb. In this embodiment, the state in which overshoot doesn't occur is one example of the "slow pitch change". However, the "slow pitch change state in which a change rate of a pitch is small" may also include a case in which overshoot occurs but a difference between the pitch of the second note (P2 in FIG. 3) and the maximum pitch (P3 in FIG. 3) is smaller than a predetermined threshold and thus the overshoot is insufficient.

The gradual pitch-change section is specified as the first section out of the "singing start sections" and the "pitch jump sections". This is because when a pitch change is gradual in the "singing start section" or the "pitch jump section", the gradual pitch-change section gives a listening sensation lacking sharpness (a listening sensation lacking a pitch accentuation feeling), thus giving to listeners an impression of drawling, poor singing. Since the "first section" is required not only to be the "singing start section" or the "pitch jump section" (first condition) but also the "gradual pitch-change section" (second condition), it goes without saying that a section satisfying only one of these conditions is not the first section.

In the specifying step SA100, the control unit 100 divides singing voice data as a processing target into frames each having a predetermined time length and performs a time-to-frequency conversion on the frames to convert the singing voice data into frequency-domain data. Then, the control unit 100 extracts a pitch (basic frequency) from the frequency-domain data in each frame to generate a pitch curve which shows a temporal change of a pitch of the singing voice over an entire singing music. A known pitch-extraction algorithm may be appropriately applied to the extraction of a pitch. The control unit 100 specifies the "singing start section" and the "pitch jump section" on a time axis with reference to the pitch curve generated in the above-described manner. Subsequently, the control unit 100 determines, with reference to the pitch curve, a causing state of the overshoot of a pitch in each section specified in this manner and specifies a section in which the overshoot doesn't occur as the first section. Specifically, supposing that a head portion of singing voice data as a processing target is defined as a counting start point of time, the control unit 100 writes, for each first section, data representing start time and end time of the first section in the volatile storage unit 132.

Figure 4:
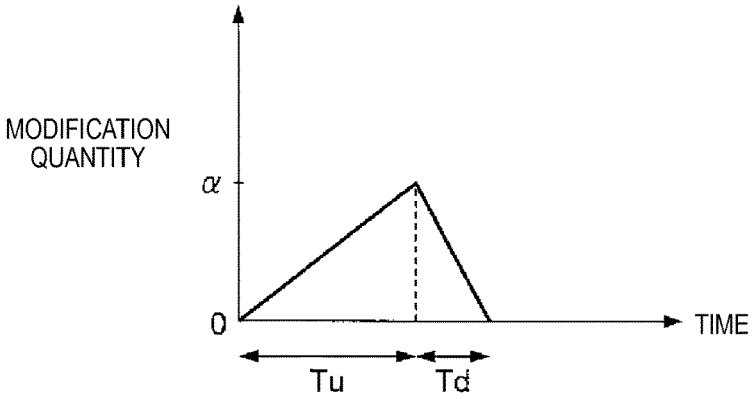
FIG. 4 is a diagram illustrating an example of modification quantity data.

The modification step SA110 is a step in which a temporal change of pitch in the first section specified in the specifying step SA100 (a time section partitioned based on time data stored in the volatile storage unit 132 in specifying step SA100) is modified so that the pitch change becomes steeper, based on a pitch which is represented by singing voice data before modification in the first section. In other words, in the modification step SA110, the temporal change of pitch in the first section specified in the specifying step SA100 is modified so as to increase a change rate of the pitch. Modification quantity data representing a modification quantity (cent) of a pitch at each time in a time section of a predetermined time length is stored in advance in the singing voice modification program according to the embodiment. The modification quantity is a quantity to be added to a pitch represented by singing voice data before modification so as to raise the pitch, and the quantity which equals to 0 means that the pitch is not raised. FIG. 4 illustrates modification quantity data in a case where a linear rising time required for a pitch to reach a maximum quantity $\alpha$ which is a quantity added to a pitch represented by singing voice data before the modification is Tu and a linear falling time required for the pitch to change from the maximum quantity $\alpha$ to 0 (its original pitch) is Td. The maximum quantity $\alpha$, the rising time Tu, and the falling time Td may be set appropriately by performing experimentations or the like. The control unit 100 modifies the temporal change of pitch in the first section in such a way that the time section (Tu, Td) of the modification quantity data is expanded/contracted according to a time length of the first section, and a pitch conversion or the like is performed on a sample data sequence of the first section so that a pitch at each time becomes a pitch modified by using the modification quantity represented by the modification quantity data.

In addition, the modification quantity may be a quantity to be multiplied to a pitch represented by singing voice data before modification so as to raise the pitch, in this case the quantity which equals to 1 means that the pitch is not raised. The modification quantity data rises from 1 to $\alpha$ in the time Tu and falls from $\alpha$ to 1 in the time Td.

Figure 5:
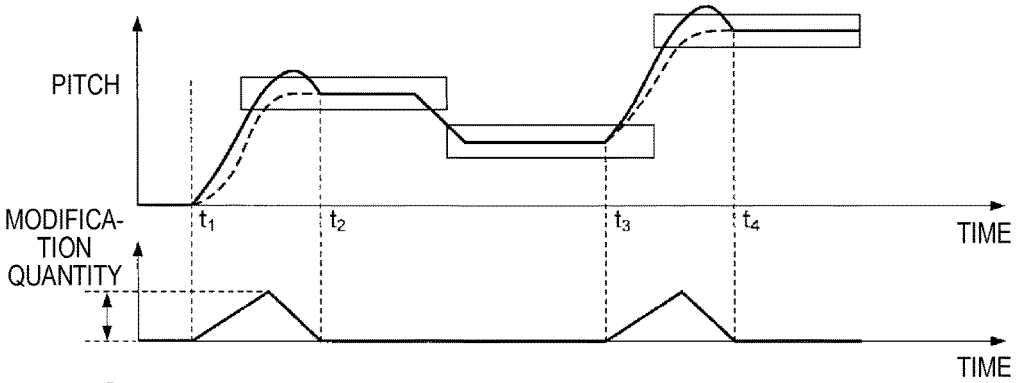
FIG. 5 is a diagram for explaining effects of a first embodiment of the invention.

FIG. 5 is a diagram for explaining effects of the embodiment. In FIG. 5, on a plane that the vertical axis is a pitch (cent) and the horizontal axis is a time, a pitch curve (temporal change of the pitch) before modification by the signal processing apparatus 10A is shown by a dotted line and a pitch curve after the modification is shown by a solid line. Further, notes which constitute a score of a music having been sung by the singer are drawn by rectangles in FIG. 5. In FIG. 5, a section from time t1 to time t2 corresponds to the "singing start section" and a section from time t3 to time t4 corresponds to the "pitch jump section". As is clear referring to the pitch curve of the dotted line in FIG. 5, overshoot of a pitch doesn't occur in any of the "singing start section" or the "pitch jump section". Thus, these two sections are objects to be modified. According to the signal processing apparatus 10A in this embodiment, these two sections each are modified to the pitch modification according to the modification quantity data and thus modified to exhibit the pitch curve of the solid line shown in FIG. 5. Consequently, the singing voice is modified to have sharpness. Note that, in FIG. 5, since the pitch modification is not performed on remaining sections other than the first sections, the pitch curve of the dotted line overlaps with the pitch curve of the solid line in the remaining sections.

According to the signal processing apparatus 10A in this embodiment, singing voice data of a moving image to be posted on the moving image posting site can be modified to singing voice data which gives an impression of better singing to listeners, and can be posted on the site. In addition, in this embodiment, the modification is performed only on the gradual pitch-change section out of the "singing start section" and the "pitch jump section" and thus the personality of the singer remains in the sections which have not been modified to the modification. Note that the personality of the singer is not completely lost in the sections which have been modified to the modification. This is because the temporal change of pitch after the modification is based on the temporal change of pitch before the modification. In this manner, according to this embodiment, an impression of a singing voice can be changed while remaining the personality of a singer.

In this embodiment, as examples of the slow rate of temporal change of a pitch, the state in which the overshoot of the pitch doesn't occur and the state in which the overshoot is small are given. However, as the other examples of the slow pitch change, a state in which a preparation effect for the second note is not caused just before the pitch change to the second note or a state in which the preparation effect is small may be given. The preparation effect means an instantaneous pitch change in a reverse direction caused by the singer to prepare a pitch change from the first note to the second note just before the pitch change. For example, in a case where the "gradual pitch change" is defined as a "state in which the preparation effect is not caused", the modification step SA110 may perform signal processing to impart the preparation effect to the singing voice.

Second Embodiment

A second embodiment according to the invention will be explained.

Figure 6:
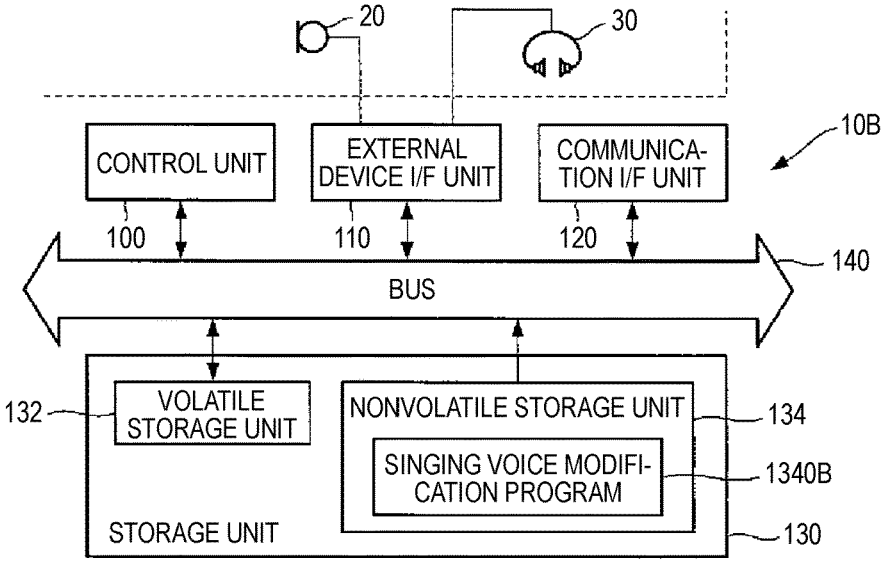
FIG. 6 is a diagram illustrating a configuration example of a signal processing apparatus 10B according to a second embodiment of the invention.

FIG. 6 is a diagram illustrating a configuration example of a signal processing apparatus 10B according to the second embodiment of the invention. In FIG. 6, constituent elements identical to those of FIG. 1 are referred to by the common symbols. As is clear by comparing FIG. 6 with FIG. 1, although a hardware configuration of the signal processing apparatus 10B is the same as the hardware configuration of the signal processing apparatus 10A, the signal processing apparatus 10B differs from the signal processing apparatus 10A in that a singing voice modification program 1340B is stored in the nonvolatile storage unit 134 in place of the singing voice modification program 1340A.

The singing voice modification program 1340B is the same as the singing voice modification program 1340A at a point of causing the control unit 100 to achieve the singing voice modification processing for modifying singing voice data in such a way as to give an impression of good singing to listeners. However, the singing voice modification program 1340B in this embodiment differs from the singing voice modification program 1340A in the following two points.

Firstly, although the singing voice modification processing in the first embodiment performs the modification of temporal change of pitch in a singing voice, the singing voice modification processing in this embodiment performs modification of temporal change of volume. This is because when a volume change is gradual in the "singing start section" or the "pitch jump section", a gradual volume-change section of the singing voice gives a listening sensation lacking sharpness (a listening sensation lacking a volume accentuation feeling), thus giving to listeners an impression of drawling, poor singing. In addition, in this embodiment, a state in which a change rate of volume is small is a state in which overshoot doesn't occur in the volume change. Secondly, although the singing voice modification processing in the first embodiment is non-real-time processing which is executed after singing, the singing voice modification processing in this embodiment is real-time processing which is executed in parallel to singing and emission of a singing voice. In addition, the non-real time processing may be applied as a modified embodiment of this embodiment.

Since the singing voice modification processing in this embodiment is the real-time processing, as illustrated in FIG. 6, the external device I/F unit 110 of the signal processing apparatus 10B is connected to a microphone 20 which inputs signal voice data to this apparatus in real time and a headphone speaker 30 which feeds back a singing voice (that is, a non-modified singing voice) represented by the singing voice data to a singer. In this embodiment, although the non-modified singing voice is fed back to a singer, a modified singing voice may alternatively be fed back to a singer.

Figure 7:
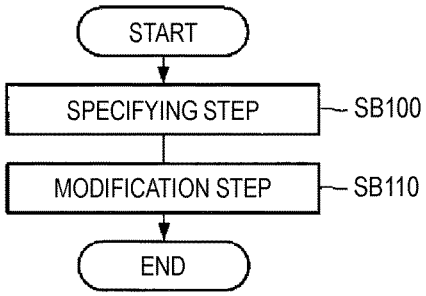
FIG. 7 is a flowchart illustrating a flow of singing voice modification processing which is executed by a control unit 100 of the signal processing apparatus 10B according to a singing voice modification program 1340B.

FIG. 7 is a flowchart illustrating a flow of the singing voice modification processing in this embodiment. As is clear by comparing FIG. 7 with FIG. 2, the singing voice modification processing in this embodiment differs from the singing voice modification processing in the first embodiment in that the specifying step SB100 is employed in place of the specifying step SA100 and that the modification step SB110 is employed in place of the modification step SA110.

The specifying step SB100 is the same as the specifying step SA100 at a point of specifying the first section. However, this embodiment differs from the first embodiment in the definition of the first section and thus differs in a method of specifying the first section. More specifically, the first sections in this embodiment are the "singing start section" and the "pitch jump section" in the singing voice. In these sections, it doesn't matter whether or not overshoot of volume occurs. This is because the real time processing is obstructed if presence or absence of overshoot is checked.

Since the singing voice modification processing in this embodiment is the real-time processing, it is impossible to generate a pitch curve to specify the "singing start section" and the "pitch jump section" as in the first embodiment. In this embodiment, score data representing a score of a singing voice as a first section is inputted into the signal processing apparatus 10B via the external device I/F unit 110 before starting the singing. The control unit 100 specifies in advance, based on a note arrangement represented by the score data, start time and end time (relative time from $\alpha$ singing start time point as a calculation start point of time) of each of the "singing start section" and the "pitch jump section". For example, a user instructs the singing start time point by operating the operation input unit connected to the external device I/F unit 110.

The modification step SB110 is a step which modifies temporal change of volume in the first section specified in the specifying step SB100 according to the temporal change. More specifically, the control unit 100 monitors input data (a sample sequence of a singing voice) from the external device I/F unit 110 for the first section while starting the clocking from the singing start time point. When input of the singing voice data in the first section specified in the specifying step SB100 starts, the control unit 100 controls a gain for amplifying an amplitude of the singing voice data according to modification quantity data so that the volume overshoots until the first section ends. The singing voice data modified in the modification step SB110 is transmitted to a predetermined destination via, for example, the communication I/F unit 120 and reproduced as sound at the destination.

In the modification step SB110, the temporal change of volume in the first section specified in the specifying step SB100 is modified so as to increase a change rate of the volume.

Figure 8:
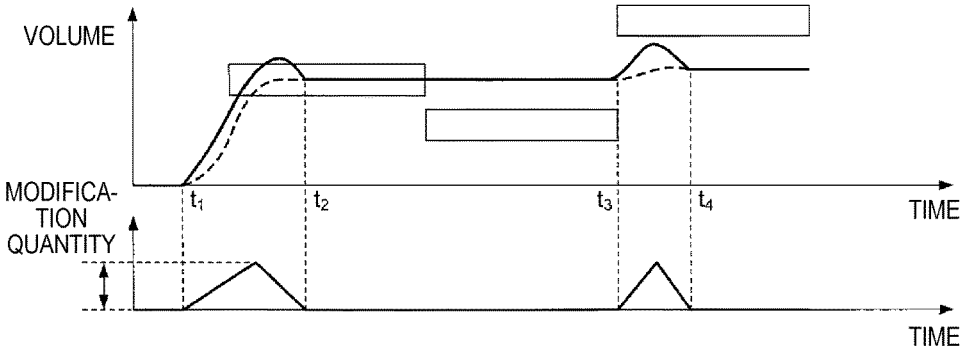
FIG. 8 is a diagram for explaining effects of a second embodiment of the invention.

FIG. 8 is a diagram for explaining effects of the embodiment. In FIG. 8, a volume curve before volumes are modified by the signal processing apparatus 10B is shown by a dotted line and a volume curve after the modification is shown by a solid line. Further, notes constituting a score of a music having been sung are drawn by rectangles in FIG. 8. Also in FIG. 8, a section from time t1 to time t2 corresponds to the "singing start section" and a section from time t3 to time t4 corresponds to the "pitch jump section". These two sections are objects to be modified. According to the signal processing apparatus 10B in this embodiment, these two sections each are modified to the volume modification according to the modification quantity data and thus modified to exhibit the volume curve of the solid line shown in FIG. 8. Consequently, the singing voice is modified to have sharpness. Note that, also in FIG. 8, since the volume modification is not performed on remaining sections other than the first sections, the volume curve of the dotted line overlaps with the volume curve of the solid line in the remaining sections.

Also according to the signal processing apparatus 10B in this embodiment, singing voice data of the moving image to be posted on the moving image posting site can be modified to singing voice data which gives an impression of better singing to listeners, and can be posted on the site. In addition, also in this embodiment, the modification is performed only on the "singing start section" and the "pitch jump section" and thus the personality of the singer remains in the sections which have not been modified to the modification. Note that the personality of the singer is not completely lost in the sections which have been modified to the modification. This is because the temporal change of volume is modified based on the volume represented by the singing voice data before the modification. In this manner, also according to this embodiment, an impression of a singing voice can be changed while remaining the personality of a singer.

Third Embodiment

A third embodiment according to the invention will be explained.

Figure 9:
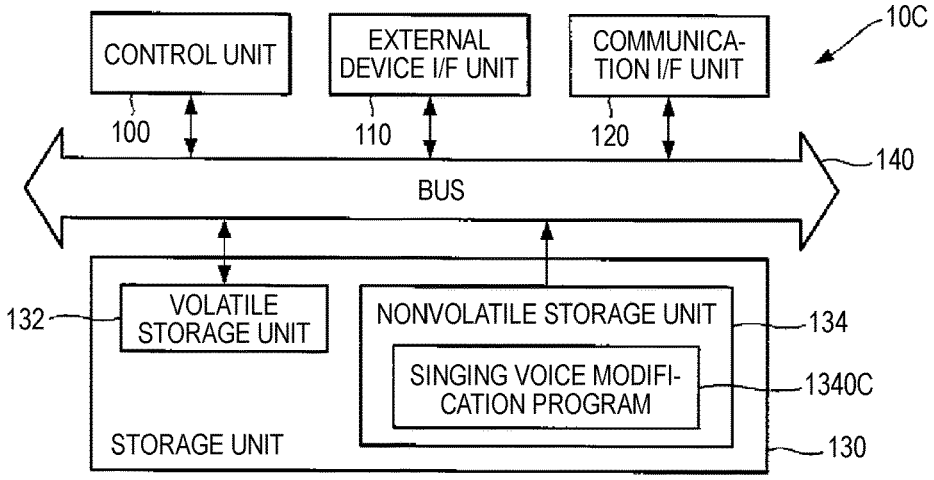
FIG. 9 is a diagram illustrating a configuration example of a signal processing apparatus 10C according to a third embodiment of the invention.

FIG. 9 is a diagram illustrating a configuration example of a signal processing apparatus 10C according to the third embodiment of the invention. In FIG. 9, constituent elements identical to those of FIG. 1 are referred to by the common symbols. As is clear by comparing FIG. 9 with FIG. 1, although a hardware configuration of the signal processing apparatus 10C is the same as the hardware configuration of the signal processing apparatus 10A, the signal processing apparatus 10C differs from the signal processing apparatus 10A in that a singing voice modification program 1340C is stored in the nonvolatile storage unit 134 in place of the singing voice modification program 1340A.

Figure 10:
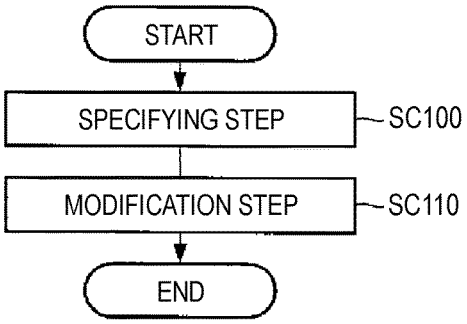
FIG. 10 is a flowchart illustrating a flow of singing voice modification processing which is executed by a control unit 100 of the signal processing apparatus 10C according to a singing voice modification program 1340C.

When the control unit 100 is instructed to execute the singing voice modification program 1340C in response to an operation for the operation input unit, the control unit 100 reads the singing voice modification program 1340C from the nonvolatile storage unit 134 and stores in the volatile storage unit 132 to start execution of this program. The control unit 100 operates according to the singing voice modification program 1340C to execute the singing voice modification processing. FIG. 10 is a flowchart illustrating a flow of the singing voice modification processing. The singing voice modification processing includes two steps, that is, a specifying step SC100 and a modification step SC110 as illustrated in FIG. 10.

Specifying step SC100 is a step of specifying a second section which is a section to be modified to modification for giving an impression of good singing to listeners, based on a singing voice which is represented by singing voice data as a processing target of the singing voice modification processing. In this embodiment, the unit 100 specifies a voiced sound section in a singing voice as the second section. The voiced sound section is a section for which a voiced sound is emitted. The voiced sound in this embodiment means a vowel. This embodiment treats only vowels as the voiced sounds, but may also treat particular consonants ("b", "d" and "g" out of plosives, "v" and "z" out of fricatives, "m" and "n" out of nasals, "l" and "r" out of liquids) other than the vowels as the voiced sounds.

In order to specify the voiced sound section in a singing voice, the control unit 100 divides singing voice data as a processing target into frames each having a predetermined time length and performs a time-to-frequency conversion on the frames to convert the singing voice data into frequency-domain data. Then, the control unit 100 tries to extract a pitch (basic frequency) for each frame from the frequency-domain data. This is because a pitch exists in the voiced sound but does not exist in an unvoiced sound or a silence. The control unit 100 sets the voiced sound section specified in this manner as the second section. Supposing that a head portion of singing voice data as a processing target is defined as a counting start point of time, the control unit 100 writes, for each second section, data representing start time and end time of the second section in the volatile storage unit 132.

Modification step SC110 is a step in which, for each second section specified in specifying step SC100, an amplitude of frequency components at the third formant and the periphery thereof is increased within a range not changing a shape of a spectrum envelope line, that is, a shape of an envelope of the spectrum envelope line in the second section. The formants represent plural peaks which move temporally and appear in a spectrum of a voice of a human who emits words. The third formant means a peak having the third lowest frequency. In general, when an amplitude of the frequency components at the third formant and the periphery thereof (both are collectively called a "third formant periphery") is insufficient, the singing voice is felt as a singing voice having massiveness as if an opera singer sings (which may be described as a powerful singing voice, a sonorous singing voice, a rich and deep singing voice, or the like), that is, felt as good singing. However, when the frequency components at the third formant periphery are insufficient, the singing voice is felt as poor singing lacking forcefulness and depth, that is, felt as unskilled singing. Because of this, this embodiment is configured to increase an amplitude of the individual frequency components at the third formant periphery in the second section. In this respect, a modification quantity of an amplitude of the individual frequency components at the third formant periphery is limited to a range not changing a shape of the spectrum envelope so that personality of a singer originated from the shape of the spectrum envelope is not spoiled.

Figure 11:
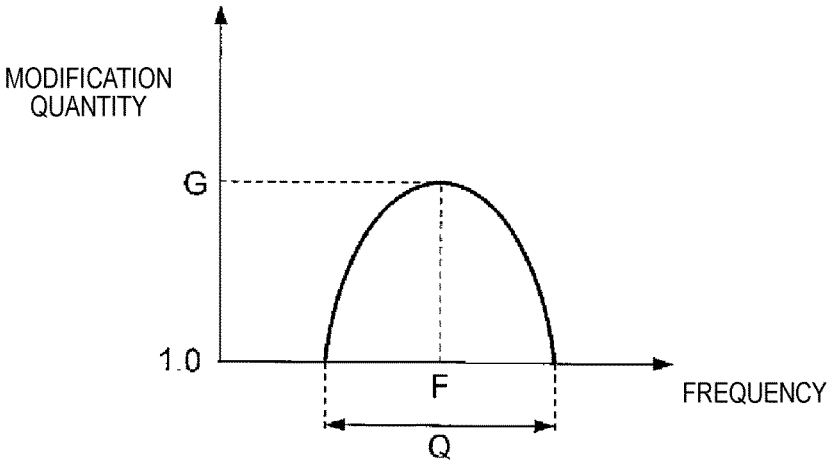
FIG. 11 is a diagram illustrating an example of modification quantity data.

Modification quantity data (see FIG. 11) which defines a modification quantity at the time of increasing an amplitude (a ratio with respect an original amplitude) of the individual frequency components within the range not changing the shape of the spectrum envelope line at the third formant periphery is embedded in advance in the singing voice modification program according to the embodiment. A frequency range Q and modification quantities G of the individual frequency components illustrated in FIG. 11 may be set appropriately by performing experimentations or the like. The control unit 100 converts, for each second section, waveform data in the second section into frequency-domain data and associates the third formant in the frequency section thus converted with a center frequency F of the frequency range Q. Then, the control unit 100 modifies the frequency components at the third formant periphery to EQ processing (processing of modifying an amplitude of each of a harmonic component and a non-harmonic component of a voice) according to the modification quantity data, thus increasing an amplitude of the individual frequency components.

Figure 12:
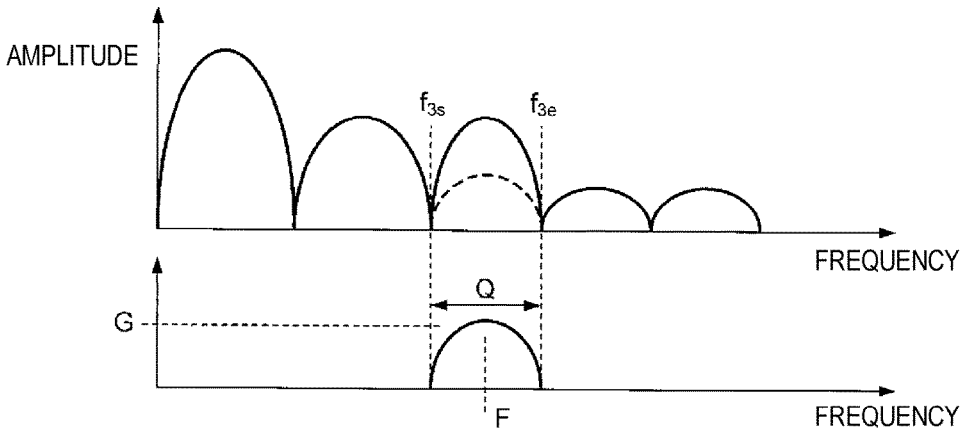
FIG. 12 is a diagram for explaining effects of the third embodiment.

FIG. 12 is a diagram for explaining effects of the embodiment. In FIG. 12, a spectrum envelope line before the modification in a certain second section is shown by a dotted line and the spectrum envelope line after the modification is shown by a solid line. Further, notes which constitute a score of a singing voice as a second are drawn by rectangles in FIG. 12. In FIG. 12, a frequency section from frequency f3*s* to frequency f3*e* corresponds to a frequency section at the third formant periphery and a center frequency of this frequency section corresponds to the third formant. According to the signal processing apparatus 10C in this embodiment, an amplitude of the frequency components belonging to this frequency section is modified according to the modification quantity data, and thus the spectrum envelope line in this frequency section is modified as illustrated by the solid line shown in FIG. 12. Consequently, the singing voice is modified to a singing voice having massiveness as if an opera singer sings. Note that, in FIG. 12, since the amplitude modification of the frequency components at the third formant periphery is not performed on remaining sections other than the second section, the spectrum envelope line of the dotted line overlaps with the spectrum envelope line of the solid line in the remaining sections.

According to the signal processing apparatus 10C in this embodiment, singing voice data of a "moving image" to be posted on the moving image posting site can be modified to singing voice data which gives an impression of better singing to listeners, and can be posted on the site. In addition, in this embodiment, the modification is performed only on the voiced sound section and thus personality of the singer remains in the sections which have not been modified to the modification. Note that personality of the singer is not completely lost in the sections which have been modified to the modification. This is because the shape of the spectrum envelope line at the third formant periphery is maintained before and after the modification. In this manner, according to this embodiment, an impression of skill of a singing voice can be changed while remaining the personality of a singer. Although this embodiment is configured to modify an amplitude of each of a harmonic component and a non-harmonic component of a voice, the harmonic component and the non-harmonic component may be separated from each other and an amplitude of only the harmonic component may be modified, thus achieving better effects (giving an impression of better singing to listeners).

Other Embodiments

Although the explanation is made as to the embodiments of the invention, these embodiments may of course be modified in the following manners.

(1) In the first and second embodiments, although the "singing start section" and the "pitch jump section" each are set as the first section (or a candidate of the first section), only one of these sections may be set as the first section (or a candidate of the first section). The modification step SA110 of the singing voice modification processing in the first embodiment may be replaced by a modification step SB110 in the second embodiment. In contrast, the modification step SB110 of the singing voice modification processing in the second embodiment may be replaced by the modification step SA110 in the first embodiment. The former mode is a mode in which the temporal change of volume of a singing voice is modified by the non-real time processing, whilst the latter is a mode in which the temporal change of pitch of a singing voice is modified by the real time processing. Both the modification of the temporal change of volume and the modification of the temporal change of pitch may be performed regardless of whether the real time processing or the non-real time processing is used.

As in the second embodiment, in the mode in which the volume change of a singing voice is modified by the real time processing, either the non-modified singing voice or the modified singing voice may be fed back to the singer. However, in the mode in which the temporal change of pitch of a singing voice is modified in real time, it is preferable to feed back the non-modified singing voice to the singer. When the modified singing voice is fed back, the singer hears the singing voice which has a pitch change different from $\alpha$ pitch change grasped by the singer. Thus, the singer has such an impression that "I should further suppress the pitch change", which may be an obstacle to singing of the singer.

In the first embodiment, although the first section is specified by analyzing the singing voice, the first section may be specified referring to the score data even in a mode of modifying the singing voice by the non-real time processing. In contrast, even in the real time processing, if a slight time lag is allowed in a period from the input of a singing voice to the reproduction of the singing voice, the first section may be specified by analyzing the singing voice data. In this case, the score data is not necessary.

(2) The embodiments each are explained as to the case where the temporal change of pitch (or the temporal change of volume) in the first section specified by the specifying step is always modified based on the singing voice data before the modification. However, the user may be made to select, by operating the operation input unit or the like, a first section in which the temporal change of pitch or the like should be modified (or a first section in which the change state of pitch or the like should not be modified) out of the first section specified by the specifying step. Alternatively, the user may be made to designate, for each first section, which to modify the temporal change of pitch or volume (or both of them).

(3) The embodiments each are explained as to the case where the singing voice data is modified so as to give the impression of good singing to listeners while remaining the personality of the singer, but the singing voice data may be modified so as to give an impression of poor singing to listeners. For example, the singing voice data may be modified so that the pitch change (or the volume change) in the first section becomes gradual, that is, the overshoot appearing at the change in a pitch (or volume) becomes small (or eliminated). This is because the range of dramatic impact expands by intentionally changing to an unskilled singing voice so as thereby to emphasize amateurishness, or the like.

(4) The third embodiment is explained as to the mode in which the singing voice modification processing is executed after the singing, that is, the case in which the singing voice modification processing is executed as the non-real time processing with respect to the singing. However, the singing voice modification processing may be executed in parallel to the singing, that is, the singing voice modification processing may be executed as the real time processing with respect to the singing. Specifically, a microphone may be connected to the external device I/F unit 110 of the signal processing apparatus 10C and singing voice data as a processing target may be inputted to the signal processing apparatus 10C via the microphone. In this case, a headphone speaker may be connected to the external device I/F unit 110 so as to feed back, to a singer, a singing voice represented by the singing voice data (that is, non-modified singing voice) or the modified singing voice.

(5) The third embodiment is explained as to the case where the modification executed by the modification step is always performed for the second section specified by the specifying step. However, the user may be made to select, by operating the operation input unit or the like, a second section in which an amplitude of the frequency components at the third formant periphery should be modified (or a second section in which the modification should not be performed) out of the second sections specified by the specifying step. Further, the user may be made to designate a degree of the modification for each second section.

(6) The third embodiment is explained as to the case where the singing voice data is modified so as to give the impression of good singing to listeners while remaining the personality of the singer, but the singing voice data may be modified so as to give an impression of poor singing to listeners. For example, an amplitude of the frequency components at the third formant periphery in the second section may be reduced within a range not changing the shape of the spectrum envelope line. This is because the range of dramatic impact expands by intentionally changing to an unskilled singing voice so as thereby to emphasize amateurishness, or the like.

(7) In each of the embodiments, the personal computer used by the poster of the moving image is operated so as to act as the signal processing apparatus according to the invention. Alternatively, the singing voice modification program may be installed in the server of the moving image posting site in advance and the server may be operated so as to act as the signal processing apparatus according to the invention. In each of the embodiments, the singing voice modification program that causes the control unit 100 to perform the singing voice modification processing, which typically represents the feature of the invention, is installed in the nonvolatile storage unit 134 in advance, but the singing voice modification program may be provided as a single unit. Each of the specifying unit for executing the processing of the specifying step and the modification unit for executing the processing of the modification step may be realized in hardware such as electronic circuits, and the signal processing apparatus according to the invention may be configured by combining these pieces of hardware.

According to the above, the first to third embodiments are explained, but the present invention can be exemplified by combining the first to third embodiment respectively in non-real-time basis. For example, in a case where the first and second embodiments are combined as non-real-time processing, a pitch change rate of a singing voice and a volume change rate of the singing voice in a first section are increased. In this case, the first section may be commonly used for the pitch modification and the volume modification. In a case where the first and third embodiments are combined, a pitch change rate of a singing voice in a first section is increased while frequency components around a third formant of a spectral envelope of the singing voice in a second section are increased or decreased. In a case where the first, second and third embodiments are combined, a pitch change rate and a volume change rate of a singing voice in a first section are increased while frequency components around a third formant of a spectral envelope of the singing voice in a second section are increased or decreased. In the last two cases, the singing voice is modified to a sharper and more massive voice.

As another mode of the invention, it is considered to provide a program which causes a general computer such as a CPU (Central Processing Unit) to execute the signal processing method (in other words, a program which causes the computer to function as the specifying unit and the modifying unit). According to this mode, it is possible to cause a general computer to function as the signal processing apparatus according to the invention. Thus, even in such a mode, an impression of a singing voice can be changed while remaining the personality of a singer. Specific examples of the mode for providing (distributing) the program include a mode for writing the program in a computer readable recording medium such as a CD-ROM (Compact Disk-Read Only Memory) or a flash ROM and distributing the medium, and a mode for distributing the program by downloading it via an electric communication line such as the internet.

One reason why singing sounds poor is that a pitch change or a volume change is gradual in a "singing start section" of a singing music or a "pitch jump section". This is because when the pitch change or the volume change is gradual in the "singing start section" or the "pitch jump section" of the singing music, it is felt that the singing lacks sharpness and is drawling. When the singing voice data is modified based on the singing voice data before the modification so that the pitch change or the volume change in the "singing start section" or the "pitch jump section" of the singing music becomes steeper, it is possible to give an impression of sharp and good singing to listeners. In a case where the pitch change or the volume change in the "singing start section" of the singing music, and the like is sufficiently steep, when the singing voice data is modified based on the singing voice data the before modification so that the pitch change or the volume change becomes further gradual, the singing voice can be modified to a poor singing voice as compared with the singing voice before the modification (in other words, a singing voice emphasizing amateurish).

According to the invention, since at least one of the pitch change and the volume change only in the modification object section specified by the specifying step is modified based on the singing voice data before the modification, the personality of a singer remains in the singing voice data other than the modification object section. Even in the modification object section, since the modification is performed based on the singing voice data before the modification, that is, based on an original change state in pitch or the like, the personality of the singer is not completely lost. In this manner, according to the invention, an impression of skill of a singing voice can be changed while remaining the personality of a singer.

The mode for specifying the first section is not limited to the aforesaid mode. For example, in the specifying step, the first section may be specified based on a degree of the pitch change in the singing voice in each of the singing start section and the pitch jump section. Specifically, a section in which a pitch changes gradually is specified as the first section out of the singing start sections and the pitch jump sections. According to this mode, the singing voice can be more finely modified according to the temporal change of pitch of the singing voice.

What is claimed is:

1. A signal processing method comprising the steps of:

specifying a first section among a duration of a singing voice of a music based on a temporal change of a pitch of singing voice data representing the duration of the singing voice of the music or a temporal change of a pitch in a score of the music; and modifying a first part of the singing voice data representing the first section of the singing voice of the music, wherein a temporal change of at least one of the pitch, a volume, and a spectral envelope of the first part of the singing voice data is modified based on the first part of the singing voice data to be modified in the modifying step.

2. The signal processing method according to claim 1, wherein in the specifying step, a singing start section of the singing voice is specified as the first section, based on the temporal change of the pitch in the score or of the singing voice data.

3. The signal processing method according to claim 2, wherein in the specifying step, the first section is specified with reference to a degree of a pitch change peculiar to the singing voice in the singing start section.

4. The signal processing method according to claim 1, wherein in the specifying step, a section in which a pitch of the singing voice jumps between two consecutive notes in the music is specified as the first section, based on the temporal change of the pitch in the score or of the singing voice data.

5. The signal processing method according to claim 4, wherein in the specifying step, the first section is specified with reference to a degree of a pitch change of the singing voice in each section in which the pitch jumps.

6. The signal processing method according to claim 1, wherein in the modifying step, the modifying process modifies both of the temporal change of the pitch and the temporal change of the volume of the singing voice in the first section.

7. The signal processing method according to claim 1, wherein in the modifying step, the temporal change of the pitch in the first section is modified so as to increase a change rate of a pitch of the singing voice in the first section.

8. The signal processing method according to claim 1, wherein in the modifying step, the temporal change of the volume in the first section is modified so as to increase a change rate of a volume of the singing voice in the first section.

9. The signal processing method according to claim 1, wherein the spectral envelope of the singing voice represented by the singing voice data has several formants respectively representing peaks that appear in a spectrum of a voice;

in the specifying step, a voiced sound section among the duration of the singing voice of the music is further specified as a second section based on the singing voice data representing the singing voice; and in the modifying step, an amplitude of frequency components of a second part of the singing voice around a third formant of the several formants of the spectral envelope is increased or decreased without changing a shape of the spectral envelope around the third formant, the second part of the singing voice data representing the second section of the singing voice of the music.

10. A signal processing apparatus comprising:

a memory that stores instructions; and a processor that executes the stored instructions to cause the signal processing apparatus to:

specify a first section among a duration of a singing voice of a music based on a temporal change of a pitch of singing voice data representing the duration of the singing voice of the music or a temporal change of a pitch in a score of the music; and modify a first part of the singing voice data representing the first section of the singing voice of the music, wherein a temporal change of at least one of the pitch, a volume, and a spectral envelope of the first part of the singing voice data is modified based on the first part of the singing voice data to be modified.

* * * * *